US011939991B2

(12) United States Patent
Leitch et al.

(10) Patent No.: US 11,939,991 B2
(45) Date of Patent: Mar. 26, 2024

(54) SAND PROTECTION DEVICE FOR DOWNHOLE PUMP

(71) Applicant: OIL TOOL SOLUTIONS, INC., Houston, TX (US)

(72) Inventors: Andrew Jardine Leitch, Olivella (ES); Mark Robinson, Houston, TX (US)

(73) Assignee: Oil Tool Solutions, Inc., Houston, TX (US)

( * ) Notice: Subject to any disclaimer, the term of this patent is extended or adjusted under 35 U.S.C. 154(b) by 9 days.

(21) Appl. No.: 17/879,105

(22) Filed: Aug. 2, 2022

(65) Prior Publication Data

US 2023/0340964 A1 Oct. 26, 2023

Related U.S. Application Data

(60) Provisional application No. 63/334,899, filed on Apr. 26, 2022.

(51) Int. Cl.

| | |
|---|---|
| ***E21B 43/38*** | (2006.01) |
| ***F04D 13/08*** | (2006.01) |
| ***F04D 15/00*** | (2006.01) |
| ***F04D 29/40*** | (2006.01) |

(52) U.S. Cl.

CPC ..... *F04D 29/406* (2013.01); *E21B 43/38* (2013.01); *F04D 13/08* (2013.01); *F04D 15/0005* (2013.01)

(58) Field of Classification Search

CPC ..... E21B 43/38; E21B 27/00; E21B 27/04; E21B 43/128; F04D 13/08

See application file for complete search history.

(56) References Cited

U.S. PATENT DOCUMENTS

| | | | | |
|---|---|---|---|---|
| 2,267,459 | A * | 12/1941 | Hait | E21B 43/38 418/48 |
| 2,347,768 | A * | 5/1944 | Crites | E21B 43/35 166/105.4 |
| 6,382,317 | B1 | 5/2002 | Cobb | |
| 8,424,597 | B2 | 4/2013 | Morrison | |
| 8,863,849 | B2 | 10/2014 | Patel | |
| 2011/0024112 | A1* | 2/2011 | Ford | E21B 43/121 166/227 |
| 2012/0061073 | A1* | 3/2012 | Soni | E21B 31/00 166/99 |

(Continued)

OTHER PUBLICATIONS

Merriam-Webster: Flat https://www.merriam-webster.com/dictionary/flat (Year: 2023).*

(Continued)

*Primary Examiner* — David Carroll

(74) *Attorney, Agent, or Firm* — Edmonds & Cmaidalka, P.C.

(57) ABSTRACT

Device and method for protecting a submersible pump. The device can include a housing for connecting to a downhole pump, and a plurality of shelves disposed throughout the housing, wherein at least two shelves are axially spaced from one another, and each shelf provides a surface for supporting and collecting sand or other solids within the housing. A restrictor assembly can be disposed at one end of the housing and configured to allow fluid flow through the housing in one direction and at least partially restrict flow through the housing in an opposite, second direction.

15 Claims, 13 Drawing Sheets

(56) References Cited

U.S. PATENT DOCUMENTS

| | | | | |
|---|---|---|---|---|
| 2014/0014358 | A1* | 1/2014 | Leitch | E21B 43/08 166/105.4 |
| 2021/0164310 | A1* | 6/2021 | Head | E21B 43/121 |
| 2022/0331714 | A1* | 10/2022 | Coon | B01D 21/0087 |

OTHER PUBLICATIONS

Merriam-Webster: Substantially https://www.merriam-webster.com/dictionary/substantially (Year: 2023).*

* cited by examiner

SAND PROTECTION DEVICE FOR DOWNHOLE PUMP

CROSS-REFERENCE TO RELATED APPLICATIONS

This application claims priority to U.S. Provisional Patent Application having Ser. No. 63/334,899, filed on Apr. 26, 2022. The entirety of which is incorporated by reference herein.

TECHNICAL FIELD

The present invention relates to sand protection devices for downhole pumps and methods for using same.

BACKGROUND

Electrical submersible pumps ("ESPs") and progressive cavity pumps ("PCPs") can be used for a variety of applications at or on the surface and underground in subterranean wells, most commonly in hydrocarbon extraction, such as oil wells, or geothermal systems, such as water heating systems. Subterranean wells can be drilled from the surface into a formation often several thousand feet deep and typically lined with a metal casing to prevent the collapse of the formation.

An ESP can be typically used at the bottom of the production tubing and deep within the wellbore. An ESP typically includes an electrical motor controlled by a power cable from the surface, a seal section which provides sealing and pressure protection for the motor, and a centrifugal pump having multiple impeller stages designed to increase pressure. ESPs can be highly efficient pumps capable of high production rates and can be particularly well suited for the production of lighter crudes and superheated water as in geothermal wells.

PCPs can be also located at the bottom of the production tubing. PCPs can be mechanical positive displacement pumps driven by a continuous shaft from the surface. The shaft can be typically engaged with a drive system at the surface and rods pass down the production tubing to a rotor, the rotor engages a stator unit, and both the rotor and the stator can be configured with helical shaped protrusions located within the pump housing. During operation the rotation of the rotor within the stator provides positive displacement, allowing production to surface. PCPs can be generally specified for higher crudes and lower production rates.

Particularly in oil wells, sand can also be produced in large quantities, typically measured in parts per million. Sand can be erosive when contacting other materials or surfaces. Particularly though, sand entrained in the column of fluid above the pump, may settle back on top of the pump when the system is shut down. Shutdowns can occur for a variety of reasons, such as sudden power outage at the surface, and for controlled procedures, such as shutdown for management and maintenance.

When sand settles back to the top of the pump, falling by virtue of gravity, the sand primarily fills the upper stages or sections of the pump, thereby creating additional frictional force preventing rotation of the shaft, and in particular, reducing the head of pressure that can be produced. In doing so, a column of sand above may be formed, creating a plug which further constrains the pump. Due to the depth of the pump in the well, and the amount of sand involved, a plug often means a full tubing joint of sand can settle on the pump, creating a significant barrier for the pump to overcome when restarting. In many cases the pump may not able to overcome the blockage and so eventually burns out due to lack of fluid. In such instances, the entire pump has to be retrieved to surface, requiring the removal of the production tubing and associated equipment also, in what can be called a workover. A workover, whilst sometimes planned, can be a very expensive operation that may be further exacerbated because of lost production.

Conventional sand protection devices have been used that divert the sand to an annular chamber or divert the sand into the production zone below the ESP. However, diversion to an annular chamber still allows finer particles to reach the ESP and cannot be entirely flushed due to their geometrical design. Likewise, diversion of sand from the system by exiting the tubing string entirely, leaves the system subject to external conditions that may prevent sand removal and allow sand to enter or block the ESP.

There is still a need, therefore, for new tools and devises for handling sand in a wellbore equipped with a submersible pump.

SUMMARY

A downhole tool for protecting submersible pumps and methods for using same are provided. The tool can include a housing for connecting to a downhole pump, and a plurality of shelves disposed throughout the housing, wherein at least two shelves are axially spaced from one another, and each shelf provides a surface for supporting and collecting sand or other solids within the housing. A restrictor assembly can be disposed at one end of the housing and configured to allow fluid flow through the housing in one direction and at least partially restrict flow through the housing in an opposite, second direction.

Each shelf can be disposed about a shaft that is located within the housing. Alternatively, each shelf can be contained within a cartridge body that is inserted within the housing. Each shelf can be flat, substantially flat, curved, sinusoidal or helically shaped. Any two or more shelves can form a petal shape. The restrictor assembly can include at least one of a castellated ball, poppet, or flapper valve. The housing can provide a single flow path through the device, meaning the tool has no bypass flow path.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

More particularly, FIG. 3A depicts an illustrative cross-sectional view; FIG. 3B depicts an illustrative side view of the support depicted in FIG. 3A; FIG. 3C depicts a top-down illustrative view of the support depicted in FIGS. 3A and 3B; and FIG. 3D depicts an isometric illustrative view of the support depicted in FIGS. 3A-3C.

FIG. 4A shows an illustrative cross-sectional view; FIG. 4B shows an isometric cross-sectional view; FIG. 4C shows a side view; FIG. 4D shows a top view; and FIG. 4E shows a bottom view with petal shelves in an open configuration.

FIG. 5A shows an illustrative cross-sectional view; FIG. 5B shows an isometric cross-sectional view; and FIG. 5C depicts an illustrative top view of the helical cartridge embodiment.

FIG. 6A depicts an illustrative cross-sectional view of a restriction mechanism or restrictor with a ball valve and castellated seat. FIG. 6B depicts an illustrative cross-sectional view of a restriction mechanism or restrictor with a poppet valve and castellated seat. FIG. 6C depicts an illustrative cross-sectional view of a restriction mechanism or restrictor with a flapper valve and castellated seat. FIG. 6D depicts an illustrative cross-sectional view of a restriction mechanism or restrictor with a castellated ball valve and plain seat. FIG. 6E depicts an illustrative cross-sectional view of a restriction mechanism or restrictor with a castellated poppet valve and plain seat. FIG. 6F depicts an illustrative cross-sectional view of a restriction mechanism or restrictor with a castellated flapper valve and plain seat.

DETAILED DESCRIPTION

Figure 1A:
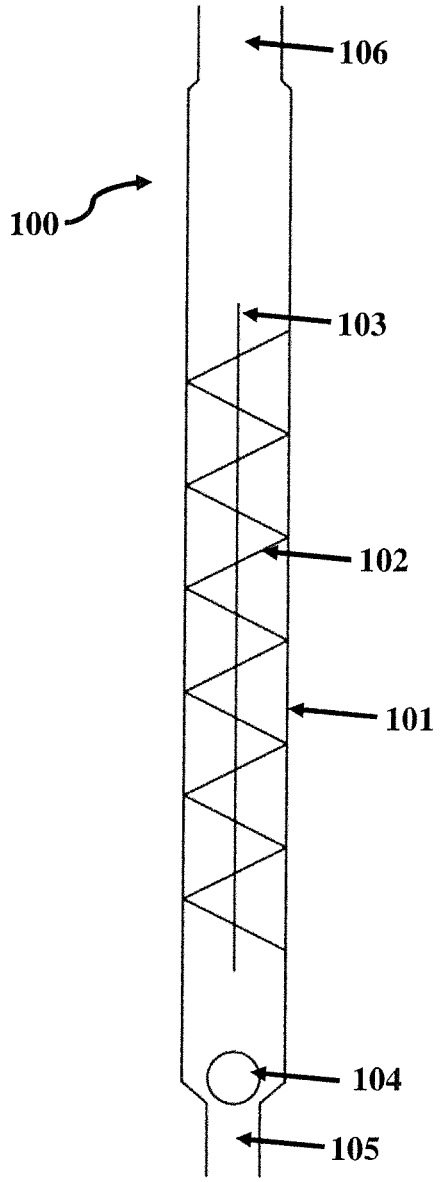
FIG. 1A depicts a simplified schematic illustration of a sand mediation tool, according to one or more embodiments described herein.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the Figures. Moreover, the formation of a first feature over or on a second feature in the description that follows may include embodiments in which the first and second features are formed in direct contact and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function.

The terms "including" and "comprising" are used in an open-ended fashion, and thus should be interpreted to mean "including, but not limited to."

The term "or" is intended to encompass both exclusive and inclusive cases, i.e., "A or B" is intended to be synonymous with "at least one of A and B," unless otherwise expressly specified herein.

The terms "up" and "down"; "upward" and "downward"; "upper" and "lower"; "upwardly" and "downwardly"; "above" and "below"; and other like terms as used herein refer to relative positions to one another and are not intended to denote a particular spatial orientation since the apparatus and methods of using the same may be equally effective at various angles or orientations.

Figure 1B:
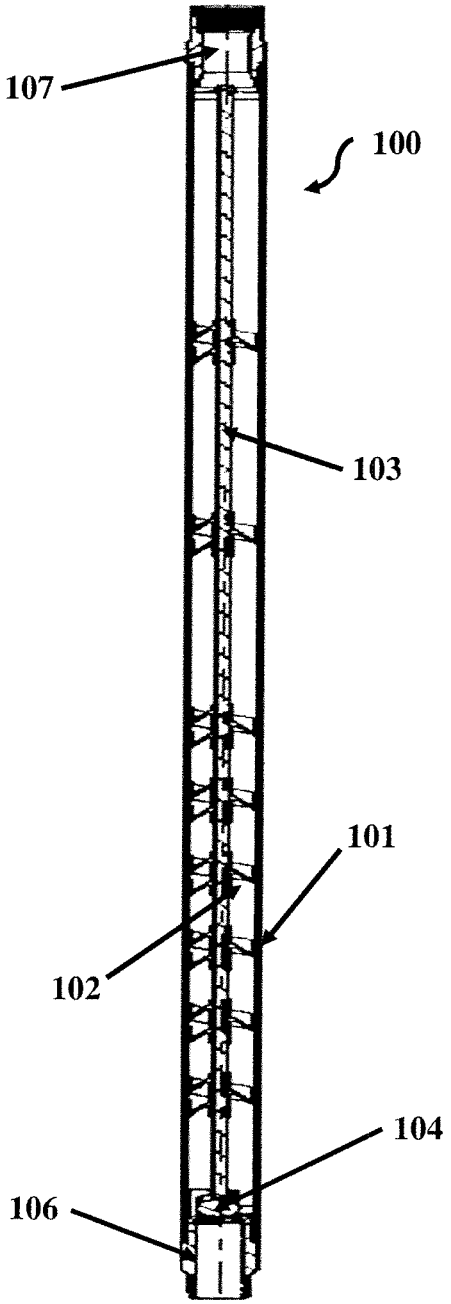
FIG. 1B depicts an illustrative cross-sectional view of the tool, according to one or more embodiments described herein.
Figure 1C:
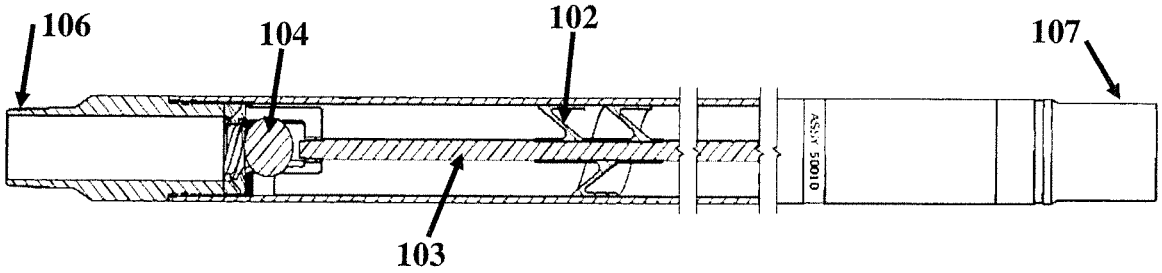
FIG. 1C depicts an enlarged partial view of the tool depicted in FIG. 1B.

A more detailed description of the sand mediation tool assembly will now be described with reference to the figures provided. Referring to FIGS. 1A-1C, the tool assembly 100 can have a tubular housing 101, a lower pump sub 106 at one end thereof to connect the tool assembly 100 to a pump and an upper surface sub 107 at an opposite, second end of the housing 101, to connect the tool assembly 100 to a tubing string or casing disposed within a wellbore. The tool assembly 100 can further include one or more collectors or collection supports 102 that can be integral with or separately disposed about a longitudinal rod or shaft 103 disposed within the housing 101. The housing 101 can have any suitable length, which can be based on operational needs. For example, the housing can be between 6 ft, 8 ft, or 10 ft, and 15 ft, 20 ft, or 25 ft. The sizing of the housing can be maximised to the available diameter within the well while providing the space to pass a power cable externally. The sand mediation tool assembly 100 is typically set above an artificial lift system in a subterranean wellbore for hydrocarbon recovery. The artificial lift system can be, for example, an electrical submersible pump (i.e. "ESP") or any type of positive displacement pump ("PDP"). The tool can be designed to prevent sand from settling on the pump outlet and blocking the fluid flow through the pump.

Figure 2:
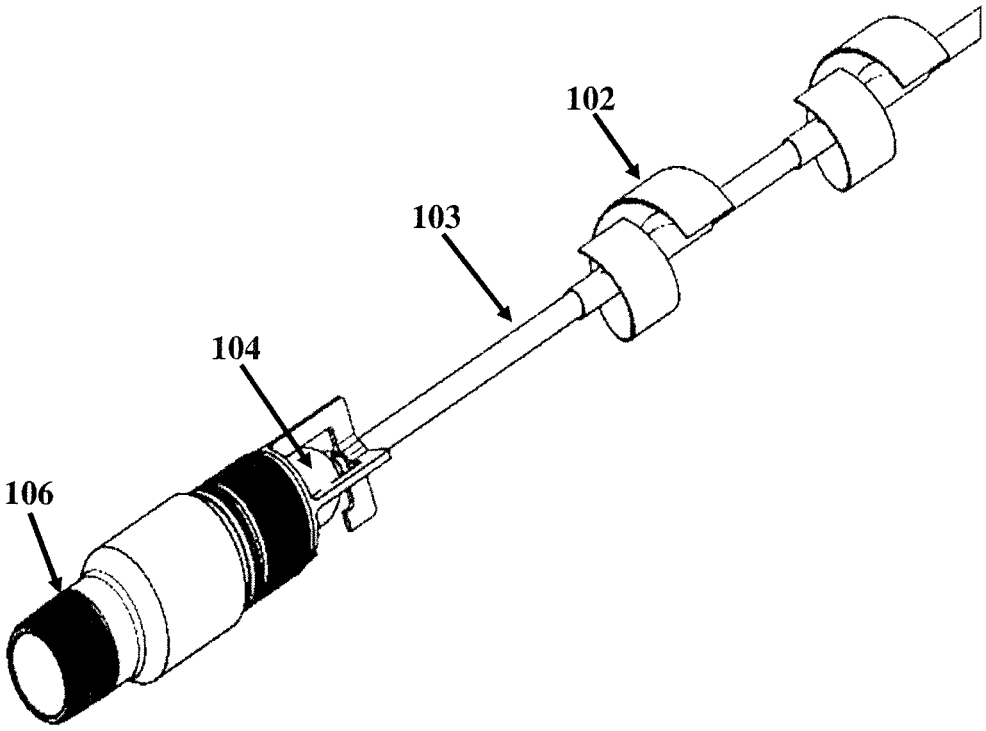
FIG. 2 depicts an illustrative isometric view of the interior of the tool depicted in FIGS. 1A-1C.

FIG. 2 depicts an illustrative isometric view of an interior of the tool assembly 100. Referring to FIGS. 1-2, the tool 100 can further include at least one restriction mechanism or restriction mechanism 104. The restriction mechanism 104 can be located at one end of the tool assembly 100, preferably further downhole or "beneath" the collection supports 102. The restriction mechanism 104 is capable of controlling, restricting and/or sealing off fluid flow in at least one direction through the tool assembly 100. The restriction mechanism 104 can be or include any type of moveable member that can engage or otherwise push against a complementary seat. As explained in more detail below, the restriction mechanism or restriction mechanism 104 can does not have to seal off the housing 101 and prevent fluid flow through the tool assembly 100. The restriction mechanism 104 can be any suitable device or member capable of slowing or restricting fluid flow to allow fluid communication into and out of the housing 101. A complete seal is not required.

For example, the restriction mechanism or restriction mechanism 104 can be or include a ball type valve, as depicted in FIGS. 1-2, that utilizes a round ball that can be sized and configured to engage a rounded seat. The restriction mechanism or restriction mechanism 104 can also be or include a melon type, mushroom type, flapper, poppet, and the like, or any castellated configuration of the same, and the seat shape can correspond to the shape and configuration of the moveable sealing member.

Considering the collection supports 102 in more detail, each collection support 102 can be constructed of any suitable material or combination of materials for downhole use, such as rubber, plastic, cast iron, steel, metal alloys or any combination thereof. Each collection support 102 can be flat, substantially flat, curved, sinusoidal or helically shaped. Any number of collection supports 102 can be used. When two or more collection supports 102 are used, the supports 102 can be located one on top of the other or can be spaced along the shaft 103. For example, the collection supports 102 can be spaced evenly, irregularly, contiguously, or at any frequency along the length of the shaft 103. Each collection support 102 can be helical, petal, slanted, triangular, or any other suitable geometry (or any combination thereof). The outer surface of each collection support 102 can be the same or different, and can be flat, cupped, concave or combinations and/or variations thereof. The purpose of the collection support 102 is to provide a shelf or surface for passively holding free falling sand or other solid debris within the housing 101.

Figure 3A:
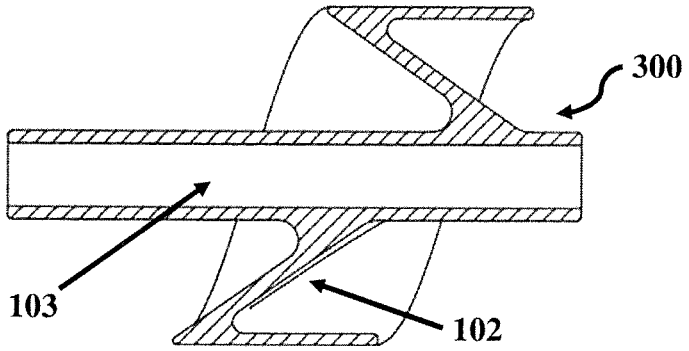
FIGS. 3A-3D show various views of a helically-shaped collection support for use with the sand mediation tool, according to one or more embodiments described herein.
Figure 3B:
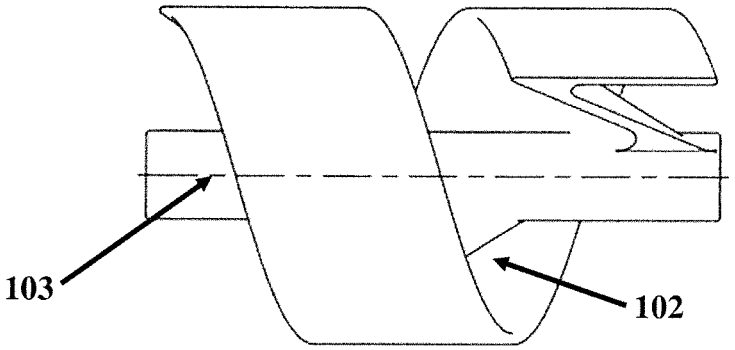
Figure 3C:
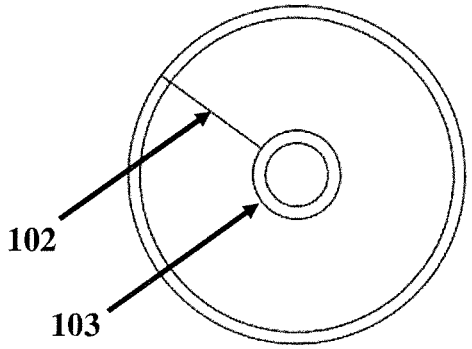
Figure 3D:
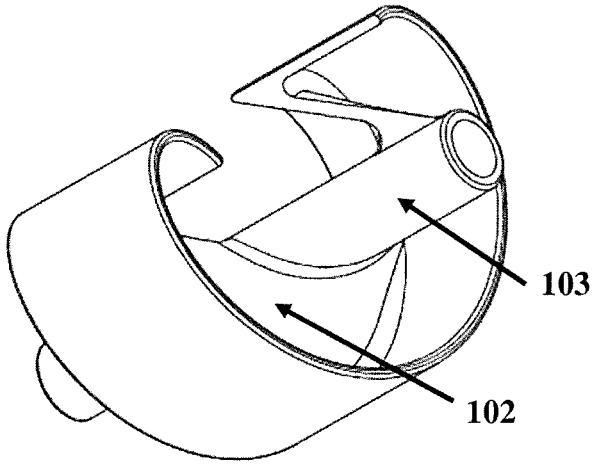

FIGS. 3A-3D show various views of a helically shaped collection support 102 for use with the tool assembly 100. More particularly, FIG. 3A depicts an illustrative cross-sectional view of the support 102; FIG. 3B depicts an illustrative side view of the support 102 depicted in FIG. 3A; FIG. 3C depicts a top-down illustrative view of the support 102 depicted in FIGS. 3A and 3B; and FIG. 3D depicts an isometric illustrative view of the support 102 depicted in FIGS. 3A-3C. The helically shaped collection support 102 can be attached to the shaft 103. The helical shape of the collection support 102 can provide a continuous path for fluids to move through the tool assembly 100.

Figure 4A:
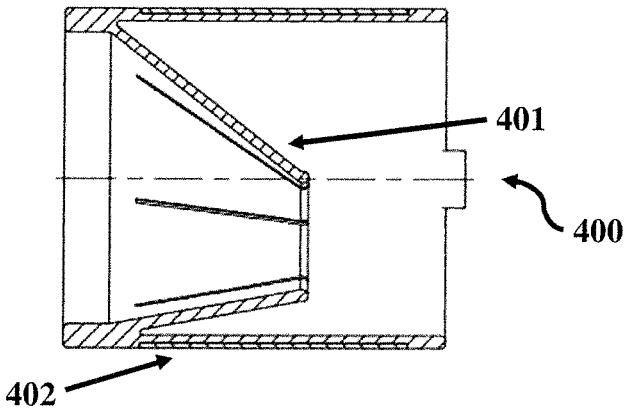
FIGS. 4A-4E show various views of a petal cartridge stage for use with the sand mediation tool, according to one or more embodiments described herein. More particularly.
Figure 4B:
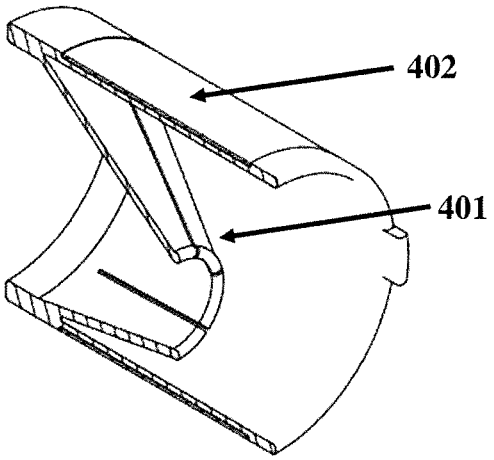
Figure 4C:
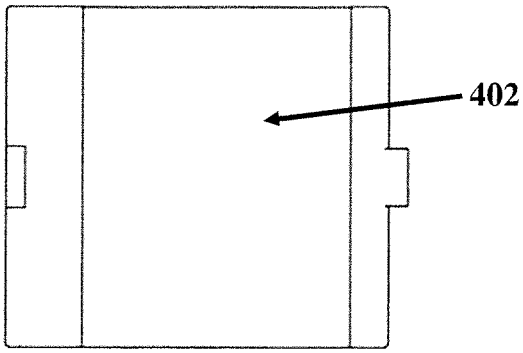
Figure 4D:
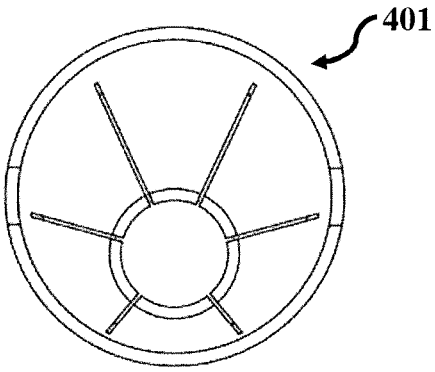
Figure 4E:
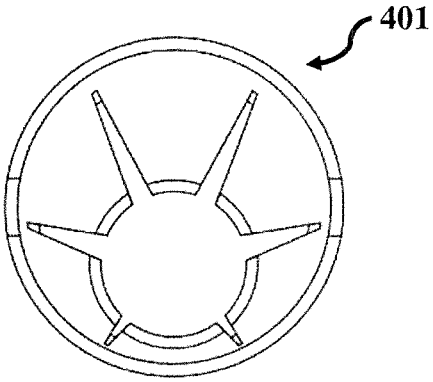

In one or more embodiments, any one or more cartridge type of collectors can be used, as depicted in FIGS. 4A-4E, which show various views of a petal type cartridge 400 for use with the assembly tool 100. More particularly, FIG. 4A shows an illustrative cross-sectional view; FIG. 4B shows an isometric cross-sectional view; FIG. 4C shows a side view; FIG. 4D shows a partial interior view with petal shelves 401 in a closed configuration; and FIG. 4E shows a partial interior view with petal shelves 401 in an open configuration. A cartridge body 402 can be used in lieu of the support shaft 103 to support one more petal shelves 401 for holding sand within the housing 101. The cartridge body 402 can be fitted, welded, secured, unsecured or otherwise disposed within the interior diameter of the tool housing 101. Each cartridge body 402 can also serve to reinforce the housing 101 wall thickness to prevent failures or leaks due to extreme internal pressure. One or more cartridge bodies 402 can be stacked on top of one another or can be spaced apart with other tubular blanks or spacers.

The petal shelves 401 can have two or more movable or flexible arms or extensions. These movable or flexible extensions can be angled and configured to restrict flow in one direction and allow unrestricted flow in an opposite direction. For example, the petal shelves 401 restrict flow towards the pump below the tool 100 and allow free fluid flow towards the wellbore surface, above the tool 100. The petal shelves 401 can also be configured to form a wider opening when flow fluids away from the pump and can likewise be configured to form a narrower opening when flow flows toward the pump. This can be advantageous in allowing the petal shelves 401 to restrict the movement of sand or other debris towards the pump while increasing the surface area available to collect falling sand or other debris within the tool 100. Additionally, the petal shelf 401 can allow flow away from the pump to disturb and carry any sand or other debris collected around the petal shelf 401 through the gaps in the movable or flexible extension.

Figure 5A:
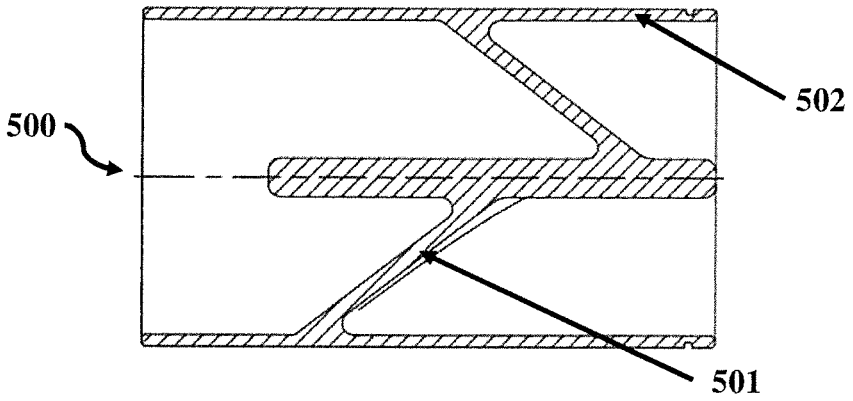
FIGS. 5A-5C show various views of a helical cartridge for use with the tool assembly, according to one or more embodiments described herein.
Figure 5B:
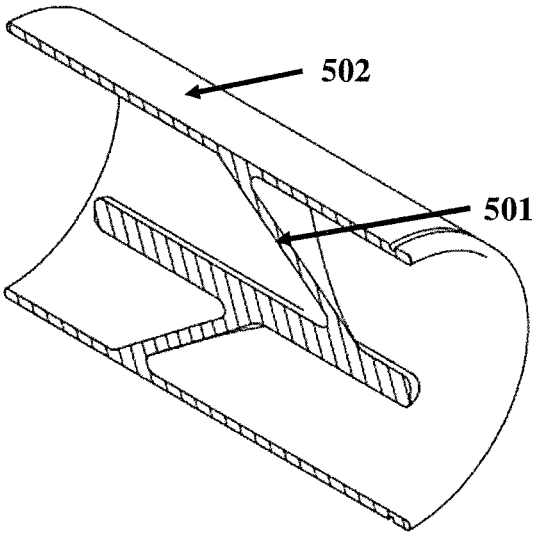
Figure 5C:
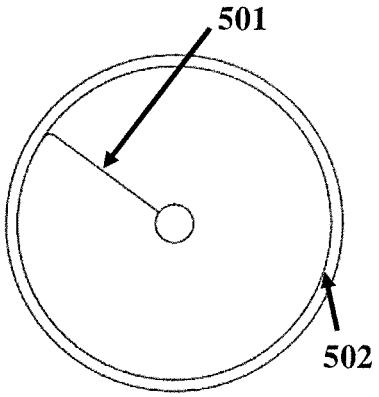

FIGS. 5A-5C show various views of a helical cartridge type 500 for use with the tool assembly 100. FIG. 5A shows an illustrative cross-sectional view; FIG. 5B shows an isometric cross-sectional view; and FIG. 5C depicts an illustrative top view of the helical cartridge 500. The helical cartridge 500 can include a body 502 that contains at least one helically-shaped rib or collection surface 501. The helical rib 501 can extend radially from an axial central support 503 and secured to an inner surface of the surrounding body 502. The outer surface of the helical rib 501 can be flat, cupped, concave, or combinations thereof.

Figure 6A:
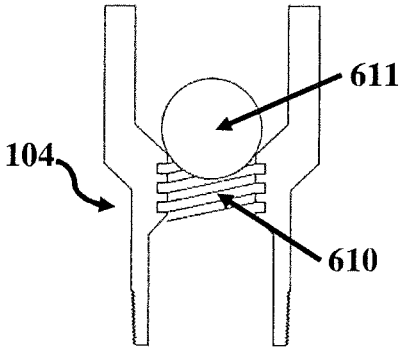
FIG. 6A-6F show various configurations of a restriction mechanism or restrictor assembly that can be used with the sand mediation tool, according to one or more embodiments described herein.
Figure 6B:
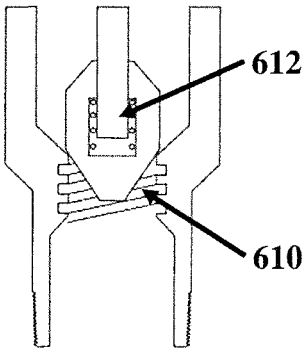
Figure 6C:
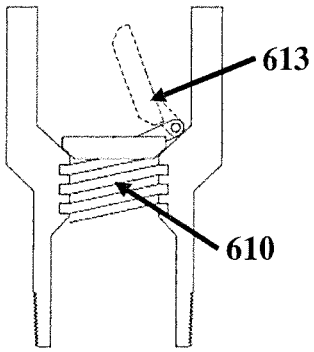
Figure 6D:
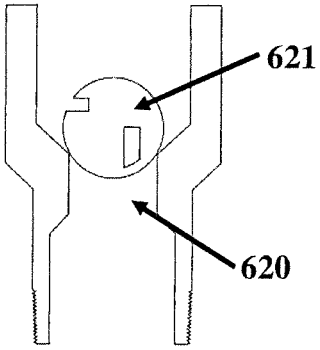
Figure 6E:
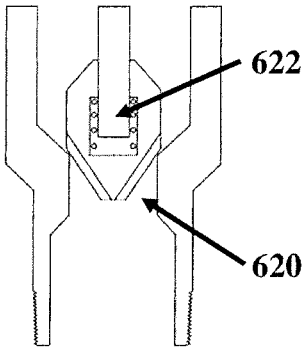
Figure 6F:
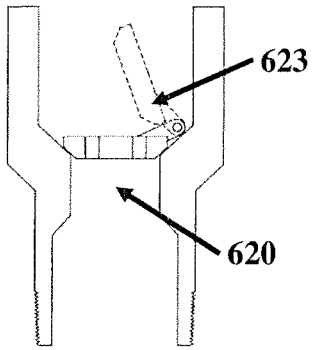

Considering the restriction mechanism or restriction mechanism 104 in more detail, FIGS. 6A-6F show various configurations that can be used with the tool assembly 100 to restrict fluid therethrough. FIG. 6A depicts an illustrative cross-sectional view one embodiment with a ball valve 611 and castellated seat 610. FIG. 6B depicts an illustrative cross-sectional view of another embodiment using a poppet valve 612 and castellated seat 610. FIG. 6C depicts an illustrative cross-sectional view of yet another embodiment using a flapper valve 613 and castellated seat 610. FIG. 6D depicts an illustrative cross-sectional view of still another embodiment using a castellated ball valve 621 and plain seat 620. FIG. 6E depicts an illustrative cross-sectional view of still another embodiment using a castellated poppet valve 622 and plain seat 620. FIG. 6F depicts an illustrative cross-sectional view of still yet another embodiment using a castellated flapper valve 623 and plain seat 620.

It should be appreciated that the restriction mechanism 104 does not completely restrict flow to and from the pump. According to one or more embodiments, any imperfections or any castellated valve can provide protrusions and/or gaps to allow fluid flow therethrough, even while the restrictor 104 is in a closed configuration. This constant fluid communication helps, and in some cases, prevents sand or other debris from forming a densely packed plug at or around the surface of the restrictor 104 that may be difficult for the pump to clear, upon restart.

Figure 7A:
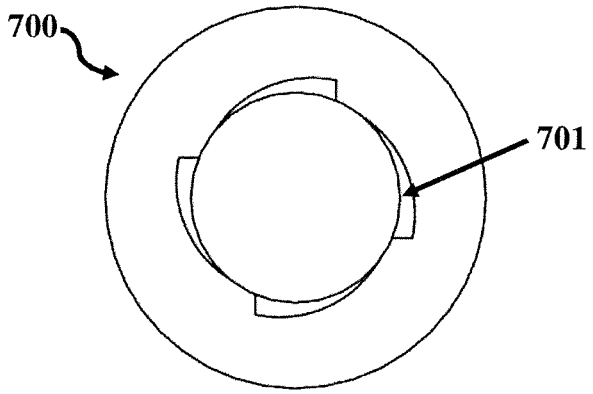
FIG. 7A depicts an illustrative top view of a check seat having a castellated helical seat, according to one or more embodiments described herein.
Figure 7B:
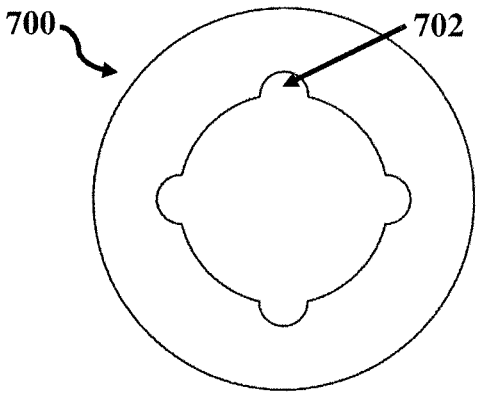
FIG. 7B depicts an illustrative top view of a check seat having a plain seat, according to one or more embodiments described herein.

FIG. 7A depicts an illustrative top view of a seat 700 having a castellated helical seat 701. FIG. 7B depicts an illustrative top view of a seat 700 having a plain castellated seat 702. These seat configurations 701 can be configured as a castellated, plain, helical, or other appropriate geometry to form an imperfect fluid seal in the restriction mechanism or restrictor 104. The seats 700 can be machined into the tool 100. The seats seat 700 can also be a separate component that is threadably or otherwise connected to the tool 100.

Figure 8A:
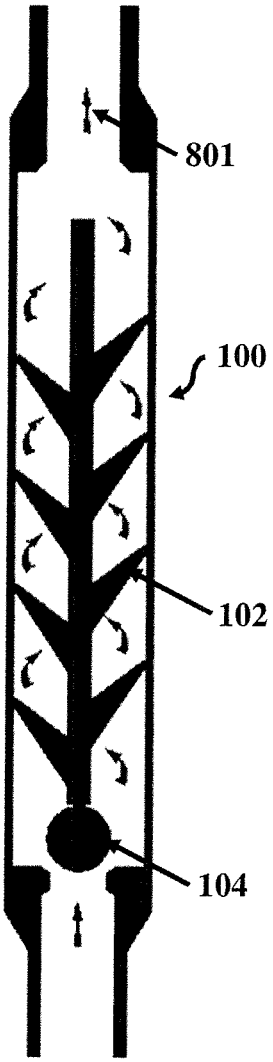
FIG. 8A depicts a simplified schematic of the tool assembly while in use during normal pumping operations, according to one or more embodiments described herein.
Figure 8B:
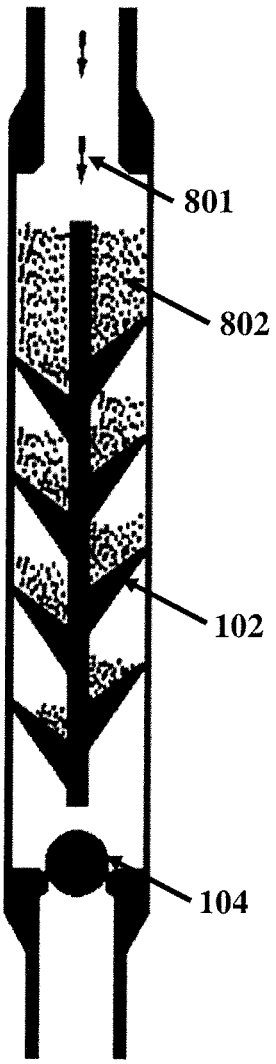
FIG. 8B depicts a simplified schematic of the tool assembly after pumping operations can be stopped and sand can settle, according to one or more embodiments described herein.
Figure 8C:
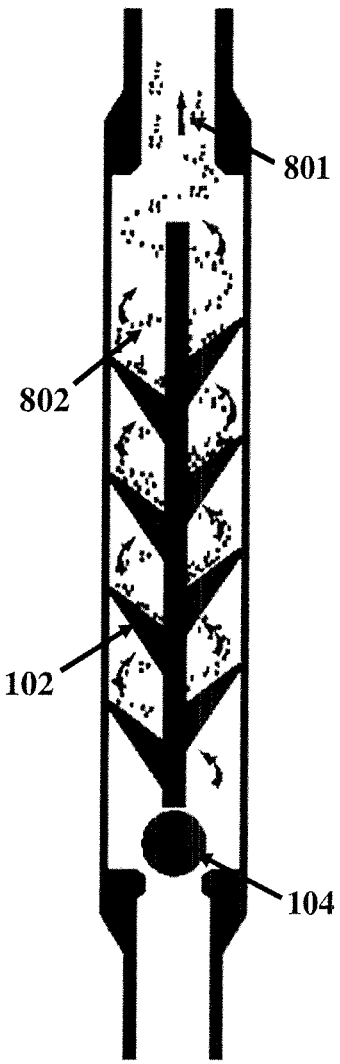
FIG. 8C depicts a simplified schematic of the tool assembly after pumping operations can be resumed and the settled sand can be removed, according to one or more embodiments described herein.

FIGS. 8A-8C depict various view of the tool 100 while in use. FIG. 8A depicts a simplified schematic of the tool assembly 100 during normal pumping operations when an upward fluid flow 801 moves through the tool assembly 100 and around the collection supports 102 (or cartridges 400, 500 (not shown)) while the restriction mechanism or restrictor 104 is in an open position.

FIG. 8B depicts the tool assembly 100 after pumping operations are stopped, the flow restrictor 104 is closed, and sand 802 settles on the collection supports 102 (or cartridges 400, 500 (not shown)) due to gravity. When in the stopped position, the restrictor 104 still allows fluid flow to and from the pump, while restricting sand or other debris from passing to the pump. Sand 802 and other debris are more likely to settle on the uppermost collection supports 102 before spilling over and settling on the lower supports 102. This can be advantageous when pumping operations are resumed because the additional fluid volume between the furthest collection supports 102 and the pump helps drive the collected sand.

FIG. 8C depicts a simplified schematic of the tool assembly 100 after pumping operations are resumed and the settled sand 802 begins to lift due to the fluid drive from the pump. The fluid flow 801 can again maintain the open position for the restriction mechanism or restrictor 104 while the collect sand and other debris 802 can be carried by the fluid flow 801 out of the tool assembly 100 and towards the surface.

Figure 9A:
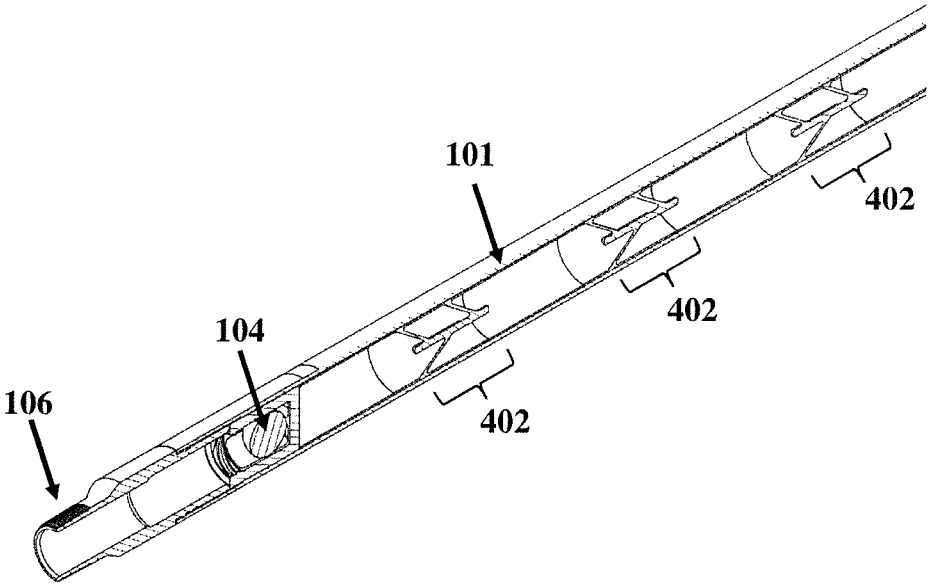
FIG. 9A depicts an illustrative cross-sectional view of the tool assembly using helical cartridges as depicted in FIGS. 5A-5C.
Figure 9B:
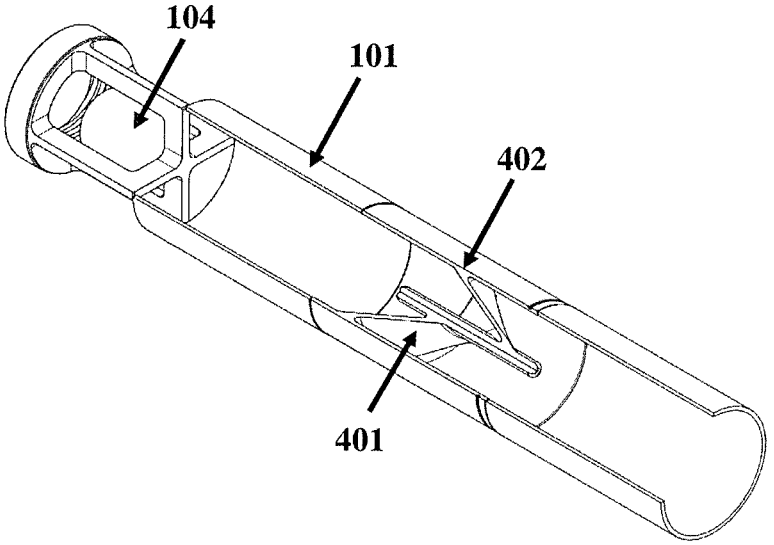
FIG. 9B depicts a closer illustrative cross-sectional view of the tool assembly depicted in FIG. 9A.

To further illustrate the cartridge type (400, 500) embodiments, FIGS. 9A and 9B are provided. FIG. 9A depicts an illustrative cross-sectional view of the tool assembly 100 equipped with helical cartridges 500 as depicted in FIGS. 5A-5C. FIG. 9B depicts a closer illustrative cut away view of the tool assembly 100 depicted in FIG. 9A. As depicted, each cartridge body 402 can be fitted to the interior diameter of the surrounding tool assembly 100. Each cartridge body 402 can be fixed to the inner diameter of the surrounding tool housing 101, or each cartridge body 402 can be allowed to freely rotate within the housing 101. As such, each cartridge body 402 can be removed and replaced, which significantly reduces the costs of repair and/or maintenance.

It should be appreciated that the tool 100 does not have a bypass flow path. The tool 100 has a contained, single flow path through its housing 101, as depicted in the figures provided herein. The single flow path through the housing 101 is controlled and regulated using the restriction mechanism 104.

Various terms have been defined above. To the extent a term used in a claim is not defined above, it should be given the broadest definition persons in the pertinent art have given that term as reflected in at least one printed publication or issued patent. All numerical values in this disclosure may be exact or approximate values unless otherwise specifically stated. Accordingly, various embodiments of the disclosure may deviate from the numbers, values, and ranges disclosed herein without departing from the intended scope.

Furthermore, all patents, test procedures, and other documents cited in this application can be fully incorporated by reference to the extent such disclosure is not inconsistent with this application and for all jurisdictions in which such incorporation is permitted.

While the foregoing is directed to more preferred embodiments of the present invention, other and further embodiments of the invention may be devised without departing from the basic scope thereof, and the scope thereof is determined by the claims that follow.

What is claimed is:

1. A device for protecting a submersible pump, comprising:

a housing;

a shaft centrally located within the housing, forming an annulus between the shaft and the housing;

a plurality of helically shaped shelves disposed about the shaft within the annulus, wherein at least two shelves are longitudinally spaced from one another, and each shelf provides a surface for supporting and collecting sand or other solids within the housing; and a restrictor assembly disposed at one end of the housing, the restrictor assembly configured to allow fluid flow through the housing in one direction and only partially restrict flow through the housing in an opposite, second direction.

2. The device of claim 1, wherein the restrictor assembly comprises at least one of a castellated ball, poppet, or flapper valve.

3. The device of claim 1, wherein the housing provides a single flow path through the device.

4. The device of claim 1, wherein the restrictor assembly is configured to substantially restrict flow through the housing in the opposite, second direction.

5. The device of claim 1, wherein each shelf has an outer surface that is substantially smooth, cupped, concave or combinations thereof.

6. A device for protecting a submersible pump, comprising:

a tubular housing having a single flow path therethrough;

a plurality of shelves disposed within the tubular housing, wherein the shelves are longitudinally spaced from one another and each shelf provides a surface for supporting and collecting sand or other solids within the tubular housing; and a restrictor assembly disposed at one end of the tubular housing, the restrictor assembly configured to allow fluid flow through the housing in one direction and only partially restrict flow through the housing in an opposite, second direction.

7. The device of claim 6, further comprising a cartridge body located within the housing, wherein the shelves are located within the cartridge body.

8. The device of claim 6, wherein any two or more shelves form a petal shape.

9. The device of claim 6, wherein the restrictor assembly comprises at least one of a castellated ball, poppet, or flapper valve.

10. The device of claim 6, wherein the restrictor assembly comprises a castellated base configured to substantially block flow through the housing in the opposite, second direction.

11. A method for protecting a submersible pump, comprising:

connecting a tubular housing having a single flow path formed therethrough to a first end of a downhole pump assembly, the tubular housing, comprising:

a shaft centrally located within the housing, forming an annulus between the shaft and the housing;

a plurality of helically shaped shelves disposed about the shaft within the annulus, wherein the shelves are longitudinally spaced from one another and each shelf provides a surface for supporting and collecting sand or other solids within the tubular housing; and a restrictor assembly disposed at one end of the tubular housing, the restrictor assembly configured to allow fluid flow through the housing in a first direction and only partially restrict flow through the housing in an opposite, second direction.

12. The method of claim 11, further comprising pumping a downhole fluid through the tubular housing with the pump assembly.

13. The method of claim 12, wherein the pumped fluid flows through the restrictor assembly in the first direction.

14. The method of claim 13, further comprising collecting sand or other solid debris on any one of the shelves after the pump is stopped.

15. The device of claim 6, wherein the restrictor assembly comprises a seat having a passageway therethrough and a complementary moveable device for obstructing the passageway, wherein one of the seat or moveable device is castellated to substantially restrict flow through the passageway in one direction when the moveable device contacts the seat and to provide a non-restricted flow through the passageway in an opposite direction when the moveable device does not contact the seat.

* * * * *